United States Patent [19]

Saito

[11] Patent Number: 4,563,730

[45] Date of Patent: Jan. 7, 1986

[54] VEHICLE HEAD LAMP WITH SYNTHETIC RESIN REFLECTOR AND RING-SHAPED HEAT SHIELDING MEMBER

[75] Inventor: Hidenori Saito, Ishehara, Japan

[73] Assignee: Ichikoh Industries, Ltd., Tokyo, Japan

[21] Appl. No.: 448,761

[22] Filed: Dec. 10, 1982

[30] Foreign Application Priority Data

Dec. 24, 1981 [JP] Japan ..... 56-191723[U]

[51] Int. Cl.[4] ..... F21V 29/00

[52] U.S. Cl. ..... 362/264; 362/80; 362/347; 362/294; 362/350; 362/307; 362/267; 362/310; 362/311

[58] Field of Search ..... 362/61, 80, 226, 264, 362/267, 294, 307, 310, 311, 347, 350

[56] References Cited

U.S. PATENT DOCUMENTS 2,261,508 11/1941 Trippe ..... 362/226
3,818,215 6/1974 Schmidt et al. ..... 362/226
4,149,229 4/1979 Draper ..... 362/349
4,282,565 8/1981 Hanson et al. ..... 362/267
4,412,273 10/1983 Helbig et al. ..... 362/211

FOREIGN PATENT DOCUMENTS 1184540 3/1970 United Kingdom .
2008736 6/1979 United Kingdom .

*Primary Examiner*—Peter A. Nelson
*Attorney, Agent, or Firm*—Schwartz, Jeffery, Schwaab, Mack, Blumenthal & Evans

[57] ABSTRACT

A lamp is attached to the back end of a synthetic resin reflector through a synthetic resin lamp holder. A heat shielding member made of a metal such as stainless steel, aluminium or general steel plate is appropriately attached to the lamp holder to cover the circumferential face of said lamp holder in such a way that said circumferential face is not subjected directly to the light projected from a filament in the lamp.

5 Claims, 7 Drawing Figures

VEHICLE HEAD LAMP WITH SYNTHETIC RESIN REFLECTOR AND RING-SHAPED HEAT SHIELDING MEMBER

BACKGROUND OF THE INVENTION

1. Field of the Invention

The present invention relates to a vehicle head lamp and more particularly, a vehicle head lamp comprising a reflector for reflecting the light of a lamp and a lamp holder arranged at the back end of said reflector to hold the lamp, said reflector and lamp holder being made of synthetic resin.

2. Prior Art

The vehicle head lamp of this type generally comprises attaching a lens to the front end of the reflector whose inner surface is coated by a reflecting material and which is made of a synthetic resin, arranging the lamp holder, which is made of a synthetic resin, at the back end of said reflector, and attaching the lamp to the lamp holder. High luminosity lamps such as the incandescent lamp having a high watt filament housed in the glass envelope and the halogen lamp in which halogen cycle is caused in the glass envelope are recently used to enhance forward visibility in the vehicle.

When these high luminosity lamps are employed as the vehicle head lamp, however, the circumferential face of the lamp holder made of synthetic resin is subjected directly to the light emitted from the filament and thus deteriorated. Namely, the circumferential face of the lamp holder is subjected directly to high heat caused by the light being directly projected from the filament and when the head lamp is kept turned on for a long time, the synthetic resin of which the lamp holder is made deteriorate to generate gas, oil and fat, which are condensed on the reflecting material of the reflector, so that the reflecting material is whitened to lower its reflecting efficiency and thus its light distribution capacity as well as to lose its appearance.

This disadvantage because of deterioration will also be caused in a lamp wherein the filament is arranged near the circumferential face of the lamp holder, as seen in the high luminosity lamp.

SUMMARY OF THE INVENTION

An object of the present invention is to provide a vehicle head lamp wherein a lamp is attached to the back end of a synthetic resin reflector through a lamp holder made of a synthetic resin and wherein the circumferential face of the lamp holder is protected from heat caused by the light directly projected from the filament.

Another object of the present invention is to enable even a high luminosity lamp to be used by protecting the circumferential face of said lamp holder.

A further object of the present invention is to provide a vehicle head lamp wherein protection of the circumferential face of said lamp holder made of synthetic resin can be achieved by a simple construction.

Other objects and features of the present invention will become apparent from the following detailed description of preferred embodiments.

DETAILED DESCRIPTION OF THE PREFERRED EMBODIMENTS

Figure 1:
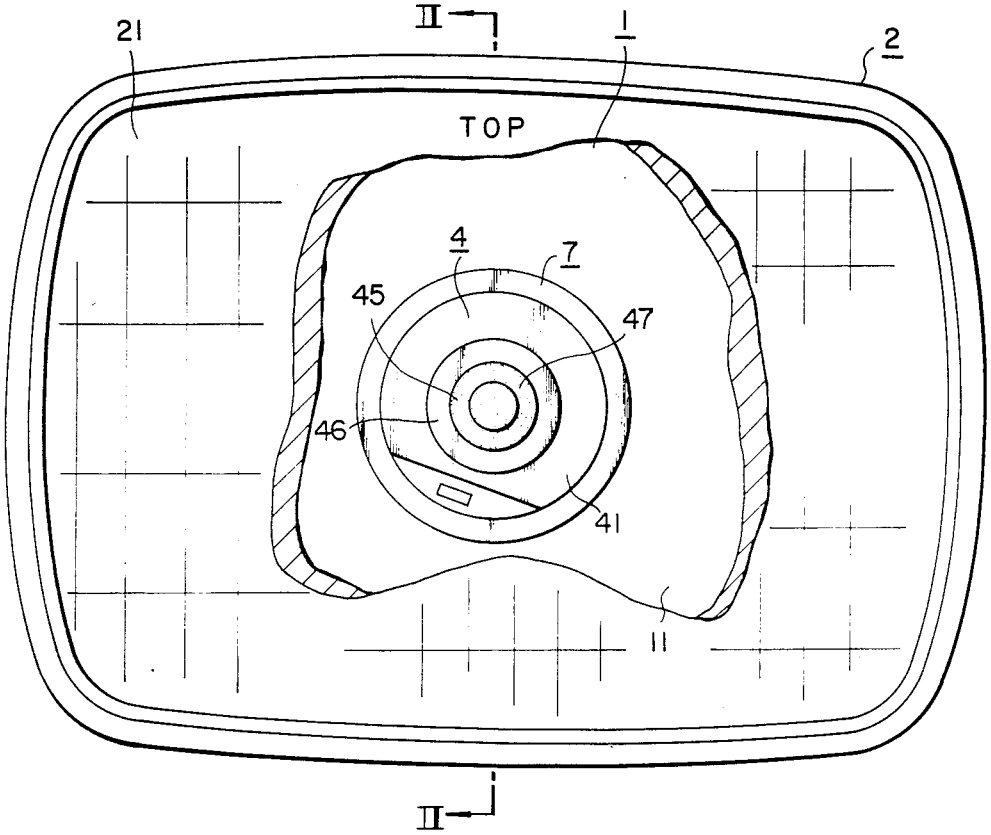
FIG. 1 is a front view, partially broken, showing an example of vehicle head lamp according to the present invention.
Figure 2:
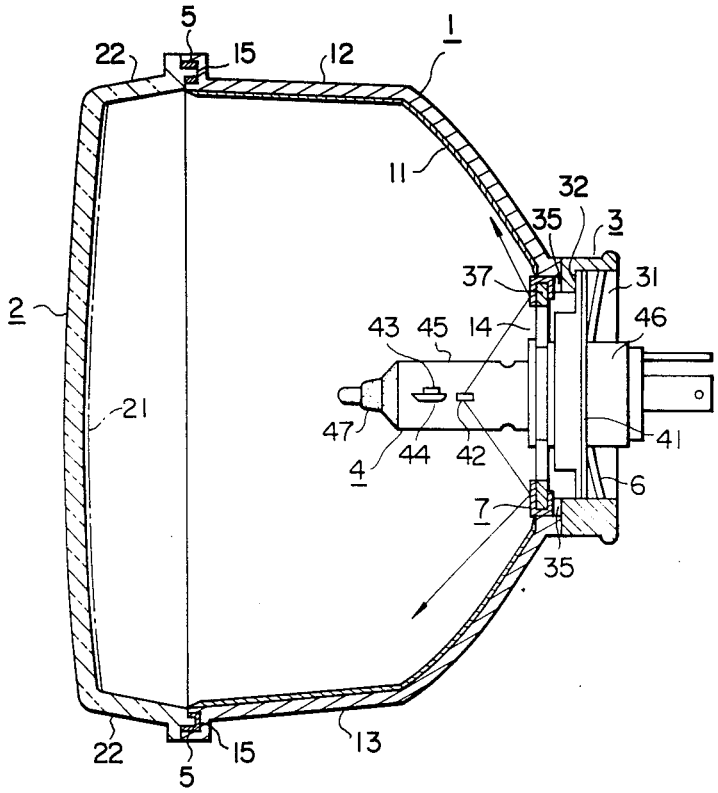
FIG. 2 is a sectional view taken along the line II—II in FIG. 1.

FIG. 1 is a front view, partially broken, showing an example of vehicle head lamp according to the present invention and FIG. 2 is a sectional view showing the same example. Numeral 1 represents a reflector whose inner surface is coated with a reflecting material 11 and the reflector is made of a synthetic resin. To the front end of the reflector 1 is attached a lens 2 while to the back end thereof is attached a lamp 4 through a synthetic resin lamp holder 3, and light projected from the lamp 4 is reflected by the reflecting material 11 in the forward direction (toward the lens 2).

To describe in more detail, the reflector 1 in this embodiment is formed by molding polybuthylene terephthalete or polycarbonate resin, and the reflecting material 11 is formed on the inner surface of the reflector 1 by vacuum-evaporating aluminium or the like. As shown in FIG. 1, this example of vehicle head lamp is of rectangular shape. Therefore, the reflector 1 is made flat to form flat portions 12 and 13, and its back inner surface is formed parabolic. A hole 14 is formed in the center of the parabolic face to receive the lamp holder 3, and a groove 15 is formed on the opened front end face of the reflector 1, said groove 15 being filled with bonding agent to attach the lens 2 to the front end face of the reflector 1.

The lens 2 is made of glass or a transparent synthetic resin such as polycarbonate resin, for example, and includes a lens face 21 having a plurality of prisms formed on the inner face thereof to control light, and a side wall portion 22 enclosing the lens face 21. The side wall portion 22 of the lens 2 is sealingly attached to the front end face of the reflector 1 by means of bonding agent 5 previously filled in the groove 15.

Figure 3:
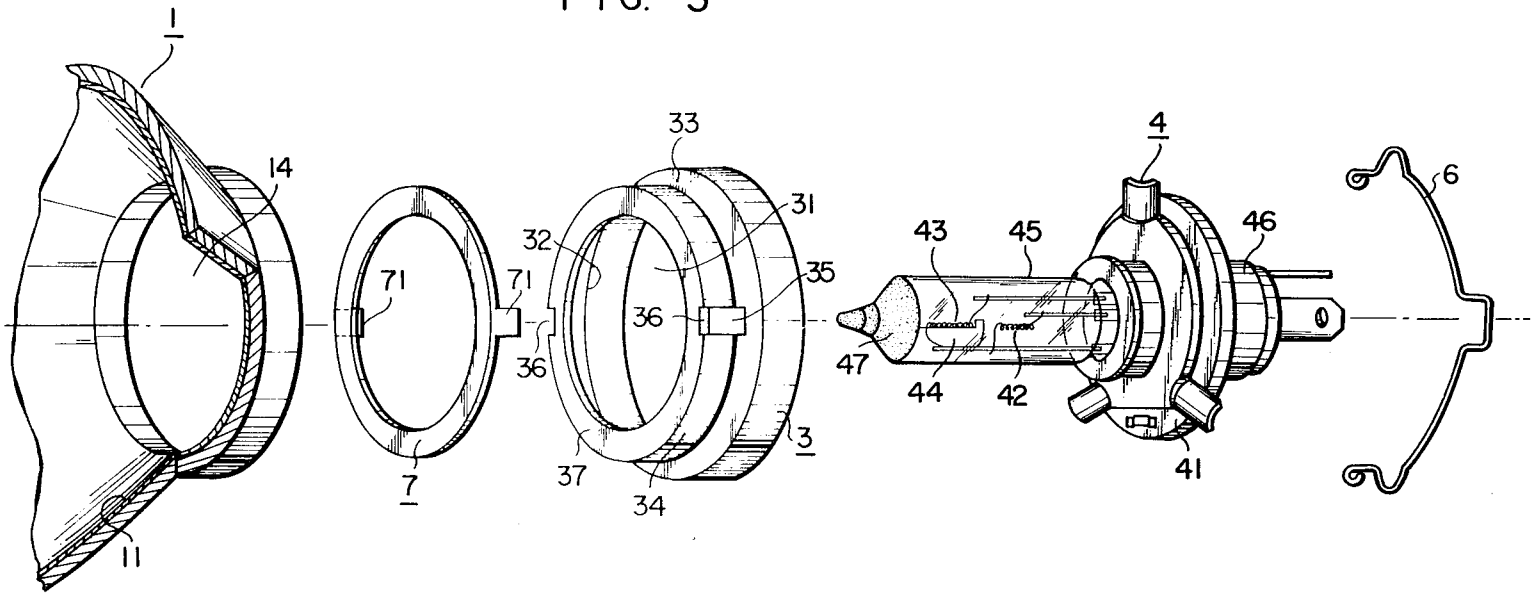
FIG. 3 is a perspective view showing the main parts of the vehicle head lamp of FIG. 2 dismantled.

The lamp holder 3 is made of polyphenylene sulphide resin, for example, and fixed to the hole 14 of the reflector 1 by push-fitting manner or using hooking pieces, for example. The lamp holder 3 is push-fitted into the hole 14 in the case of this embodiment. As shown in FIG. 3, the lamp holder 3 is of cylindrical shape having a through-hole 31 through which a glass envelope 45 for the lamp 4 is inserted into the reflector 1. A stepped portion 32 is formed on the inner wall of the cylindrical lamp holder 3. A collar portion 41 of the lamp 4 is rested on this stepped portion 32 and forced thereto by a line set spring 6 engaged with the lamp holder 3, thus enabling the lamp 4 to be attached to the lamp holder 3 (see FIG. 2). When the filament is broken, therefore, the lamp 4 can be easily detached from the lamp holder 3 by disengaging the set spring 6 from the lamp holder 3.

A shoulder portion 33 and a neck portion 34 are also formed on the outer wall of the lamp holder 3. When the neck portion 34 is push-fitted into the hole 14, the shoulder portion 33 is in contact with the outer face of the reflector 1. Said neck portion have two bores 35 and 35 and two grooves 36 and 36. Said bores 35 and 35 are formed opposite to each other in the neck portion 34. Said grooves 36 and 36 are formed on the outer wall of said neck portion 34 and extended from said bores 35 and 35 to the front end of the neck portion 34 or to a circumferential face 37 of said lamp holder 3. A heat shielding member 7 is attached to the lamp holder 3 to cover the circumferential face 37 thereof, thus shielding the circumferential face 37 from heat caused by light directly projected from filament in the lamp 4.

In this embodiment, the lamp 4 is $H_4$ type halogen lamp of high luminosity and houses in the glass envelope 45 a main filament 42, which is used when the vehicle is kept driving, and a sub-filament 43, which is used when the vehicle passes other vehicles ones. The sub-filament 43 is positioned in front of the main filament 42 and covered by a light shielding cap 44 at the lower half thereof. A base 46 is provided with the collar portion 41 and a light shielding coat 47 is applied to the front end of the glass envelope 45 to shield the light directly projected forward from the filaments 42 and 43. The lamp 4 thus arranged is attached to the lamp holder 3 in such a way that the reflector is focused between the main filament 42 and the sub-filament 43.

The heat shielding member 7 is formed by press-stamping metal plates such as aluminium, stainless steel or general steel, for example, and when general steel plate is employed, it is processed to give it a reflecting capacity. As shown in FIG. 3, the heat shielding member 7 is ring-shaped so as to cover the circumferential face 37 of the lamp holder 3. The heat shielding member 7 has two projections 71 and 71 extending backward from its outer circumference and corresponding to the bores 35 and 35. Each of said projections 71 and 71 has such a width to be inserted into the grooves 36 and 36. Therefore, the projections 71 and 71 are set in the grooves 36 and 36 and then bent into the bores 35 and 35, thus causing the heat shielding member 7 to be attached to the lamp holder 3. This presents the protrusion of the projections 71 and 71 from the outer surface of the neck portion 34, so that the neck portion 34 of the lamp holder 3 can be smoothly push-fitted into the hole 14.

According to the vehicle head lamp of the present invention, the circumferential face 37 of the lamp holder 3 which is subjected to the most intense light directly projected from the filaments 42 and 43 is covered by the heat shielding member 7, thus enabling the temperature rise to be reduced to suppress the generation of gas, oil and fat caused by deterioration of the synthetic resin. When the heat shielding member 7 is made of a metal such as stainless steel or aluminium, which are reflective in themselves, or of general steel plate which is made reflective, the directly-projected-light is reflected as shown in FIG. 2, thus enabling the circumferential face 37 to be further protected. In addition, the attachment of the heat shielding member 7 is extremely simplified.

Figure 4:
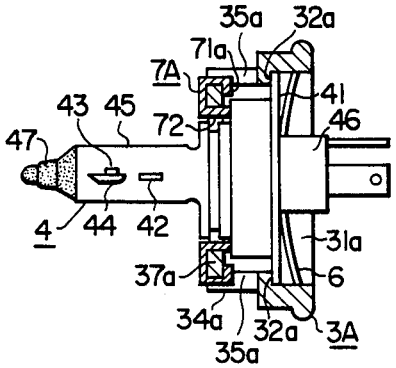
FIG. 4 is a sectional view showing the main portion of another embodiment according to the present invention.
Figure 5:
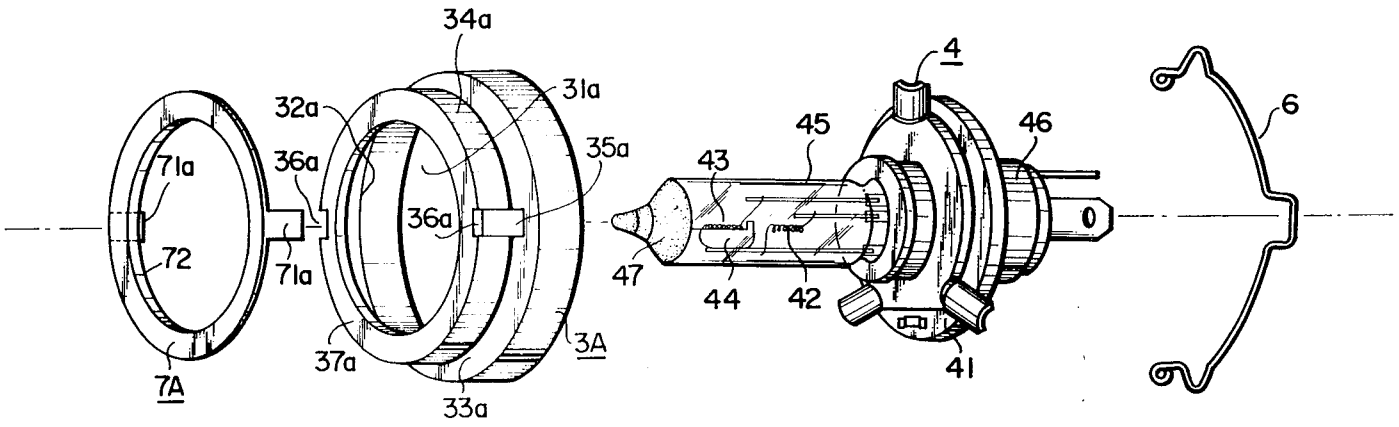
FIG. 5 is a perspective view showing the main portion in FIG. 4 dismantled.

FIGS. 4 and 5 show another example of heat shielding member 7A sectioned and dismantled.

Similar to the first embodiment, a lamp holder 3A is formed cylindrical, having a through-hole 31*a*. The lamp holder 3A is also provided with a stepped portion 32*a* on the inner wall thereof on which the collar portion 41 of the lamp 4 is rested, and a shoulder portion 33*a* and a neck portion 34*a* on the outer wall thereof. Two bores 35*a* and 35*a* are formed opposite to each other in the neck portion 34*a* and grooves 36*a* and 36*a* are formed between these bores 35*a* and 35*a* and an circumferential face 37*a*.

The heat shielding member 7A is ring-shaped to cover the circumferential face 37*a* and has a reinforcing side wall 72 projected from the inner circumference thereof. The side wall 72 is intended to cover the inner side wall of the circumferential face 37*a*. Two projections 71*a* and 71*a* which extend from the outer circumference of the heat shielding member 7A are set in the grooves 36*a* and 36 and then bent into the bores 35*a* and 35*a*, thus causing the heat shielding member 7A to be attached to the lamp holder 3. As described above, the heat shielding member 7A is designed to cover the circumferential face 37*a* and its the inner side wall, so that the circumferential face 37*a* can be still further protected.

Figure 6:
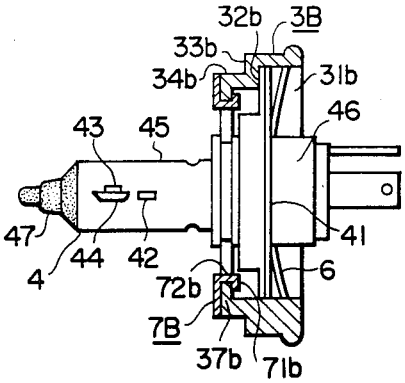
FIG. 6 is a sectional view showing the main portion of a further embodiment according to the present invention.
Figure 7:
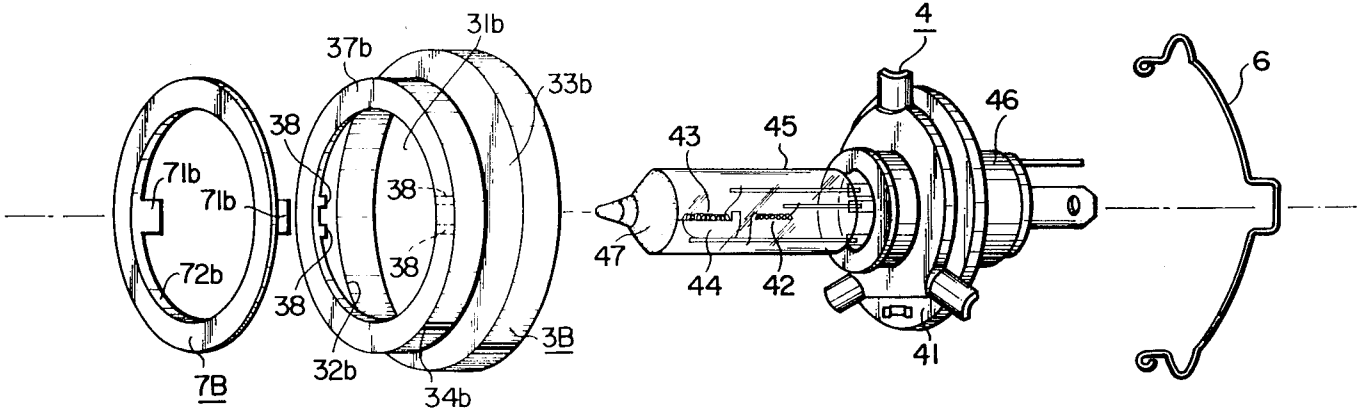
FIG. 7 is a perspective view showing the main portion in FIG. 6 dismantled.

FIGS. 6 and 7 show a further example of heat shielding member 7B sectioned and dismantled.

A lamp holder 3B is of cylindrical shape having a through-hole 31*b* and includes a stepped portion 32*b* formed on the inner wall thereof and on which the collar portion 41 is rested, and a shoulder portion 33*b* and a neck portion 34*b* formed on the outer wall thereof. Two pairs of guides 38 are formed opposite to each other on the back wall of an circumferential face 37*b* of the lamp holder 3B.

The heat shielding member 7B is ring-shaped to cover the circumferential face 37*b* and has a side wall 72*b* projecting from the inner circumference thereof to cover the inner side wall of said circumferential face 37*b*. Two projections 71*b* and 71*b* which extend backward from the side wall 72*b* are bent between one pair of guides 38 and 38 and between the other pair of guides 38 and 38, respectively. The guides 38 serve to prevent the heat shielding member 7B from rotating.

As apparent from the above, the heat shielding member of the present invention can reduce gas, oil and fat generating from the deterioration of the synthetic resin lamp holder, so that the reflecting film of the reflector can be prevented from becoming whitened to thereby keep its reflecting capacity.

It should be understood that the present invention is not limited to the above-described embodiments but that improvements and modifications not departing from the technical scope of the present invention are all included in the present invention.

I claim:

1. A vehicle head lamp, comprising:

a synthetic resin reflector provided with an attachment hole at the back end thereof and a reflecting material on the inner surface thereof;

a synthetic resin lamp holder having a through-hole and being fixed in said attachment hole;

a lamp having at least a filament housed in a glass envelope and being attached to said lamp holder in such a way that said filament is positioned inside said reflector; and a ring-shaped heat shielding member which covers the circumferential face of said lamp holder, which has a plurality of projections which attach the heat shielding member to said lamp holder, and which is made of a metal which is reflective to reflect light directly projected from said filament;

wherein said heat shielding member has a side wall which extends backward from the inner circumference thereof to cover the inner side wall of the circumferential face of said lamp holder.

2. A vehicle head lamp according to claim 1, wherein projections extending from said side wall of said heat shielding member are bent about said lamp holder.

3. A vehicle head lamp according to claim 1, wherein projections extending from the outer circumference of said heat shielding member are bent about said lamp holder.

4. A vehicle head lamp according to claim 3, wherein said projections engage grooves formed in said lamp holder.

5. A vehicle head lamp, comprising:

a synthetic resin reflector provided with an attachment hole at the back end thereof and a reflecting material on the inner surface thereof;

a synthetic resin lamp holder having a through-hole and being fixed in said attachment hole;

a lamp having at least a filament housed in a glass envelope and being attached to said lamp holder in such a way that said filament is positioned inside said reflector; and a ring-shaped head shielding member which covers the circumferential face of said lamp holder, which has a plurality of projections which attach the heat shielding member to said lamp holder, and which is made of a metal which is reflective to reflect light directly projected from said filament;

wherein said lamp is a halogen lamp.

* * * * *